US005358434A

United States Patent [19]

Brown

[11] Patent Number: 5,358,434

[45] Date of Patent: Oct. 25, 1994

[54] MOUNTING APPARATUS FOR TROLLING MOTOR

[76] Inventor: Ronald Brown, P.O. Box 783, Rock Springs, Wyo. 82902

[21] Appl. No.: 120,154

[22] Filed: Sep. 10, 1993

[51] Int. Cl.[5] ..... B63H 5/12
[52] U.S. Cl. ..... 440/60; 114/144 R
[58] Field of Search ..... 440/6, 60, 63; 248/640–643; 114/144 R

[56] References Cited

U.S. PATENT DOCUMENTS 1,091,257 3/1914 Trescott et al. ..... 440/63
5,029,547 7/1991 Novey ..... 440/60

*Primary Examiner*—Jesus D. Sotelo
*Attorney, Agent, or Firm*—Dean P. Edmundson

[57] ABSTRACT

Apparatus is described for mounting an auxiliary motor such as a trolling motor to the transom of a boat. The apparatus includes a frame, a motor mount, a pivot connection between the frame and the motor mount, a control motor supported by the frame, a gear carried by the frame and driven by the control motor, and a linking arm connected between the gear and the motor mount.

9 Claims, 6 Drawing Sheets

MOUNTING APPARATUS FOR TROLLING MOTOR

FIELD OF THE INVENTION

This invention relates to apparatus for mounting a trolling motor to a marine craft. More particularly, this invention relates to apparatus for mounting and steering a trolling motor on a marine craft.

BACKGROUND OF THE INVENTION

Trolling motors are commonly mounted to marine craft (e.g., fishing boats) for the purpose of controlling movement of the craft at slow speeds (e.g., while fishing from the craft). The trolling motor usually has low horsepower, although for large boats the trolling motor may have significant power (e.g., 25 horsepower or more). Typically the trolling motor is gasoline powered and is mounted on a pivot which enables the motor to be pivoted about a vertical axis so that it can be used to steer the boat in the desired direction.

Often steering of the trolling motor is controlled manually. For example, an arm or handle secured to the trolling motor is manipulated by a person in the boat in order to steer the craft. This is not always convenient, however, because someone must maintain virtually continuous contact with the steering arm.

Trolling motors are normally mounted to the transom of a boat by means of bolts, clamps, or brackets. Some of such mounting techniques are cumbersome to use and are not adaptable to all types of boats. Other mounting techniques are not suitable for all types of trolling motors.

Some mechanisms for controlling the steering of a motor at the rear of a boat involve use of cables and pulleys. See, for example, U.S. Pat. Nos. 4,915,050 and 3,968,768. However, cables can slip, and the proper tension must be maintained on the cables.

There has not previously been provided a system for mounting and steering a trolling motor having the advantages provided by the present invention.

SUMMARY OF THE INVENTION

In accordance with the present invention there is provided apparatus for attaching an auxiliary motor to the transom of a marine craft. In one embodiment the apparatus comprises:

(a) a frame member for attachment to the transom;
(b) a motor mount member for supporting the auxiliary motor;
(c) pivot means for enabling the motor mount member to pivot relative to the frame member;
(d) motor means supported by the frame member;
(e) gear means carried by the frame member and being adapted to be rotatably driven by the motor means; and
(f) a linking member connected between the gear means and the motor mount member for pivoting the motor mount member relative to the frame member in response to rotation of the gear means.

The apparatus is very versatile in that it can be attached to any style of transom (e.g., vertical, angled, or even horizontal swim decks). Also,the mounting bracket may be made detachable from the frame so that different types of brackets can be used, as desired.

The control motor is preferably a 12 volt, direct current motor which can be selectively driven in either forward or reverse directions so as to pivot the motor mount member to either the left or to the right. The control motor can be controlled from a remote location, if desired.

Other advantages of the apparatus of the invention will be apparent from the following detailed description.

BRIEF DESCRIPTION OF THE DRAWING

The invention is described in more detail hereinafter with reference to the accompanying drawings, wherein like reference characters refer to the same parts throughout the several views and in which.

DETAILED DESCRIPTION OF THE INVENTION

Figure 1:
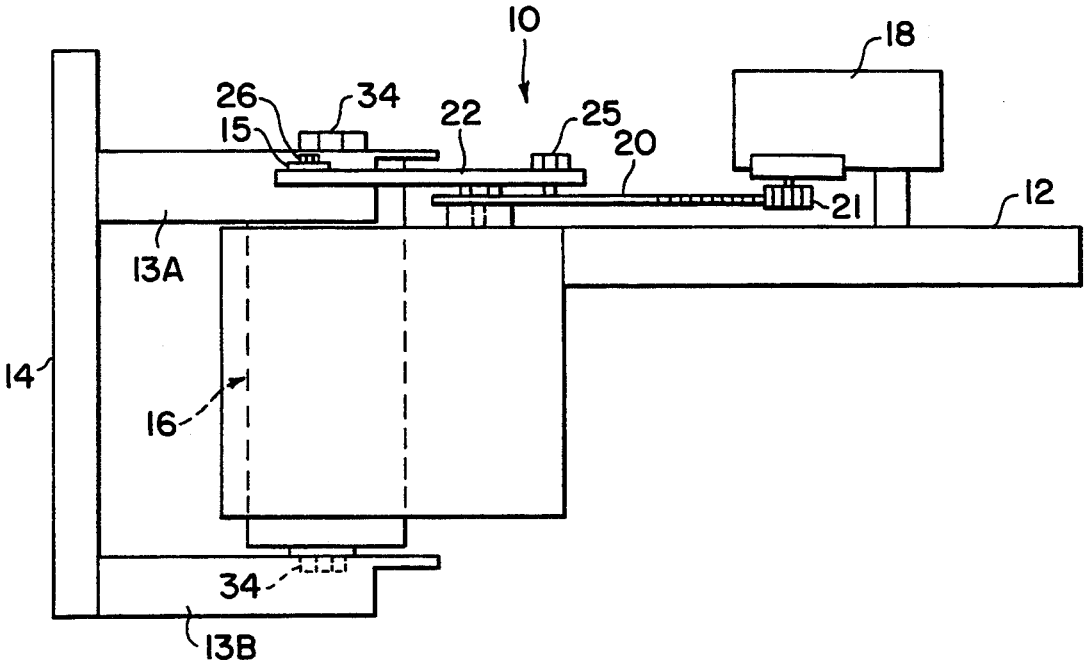
FIG. 1 is a side elevational view of one embodiment of apparatus of the invention.
Figure 2:
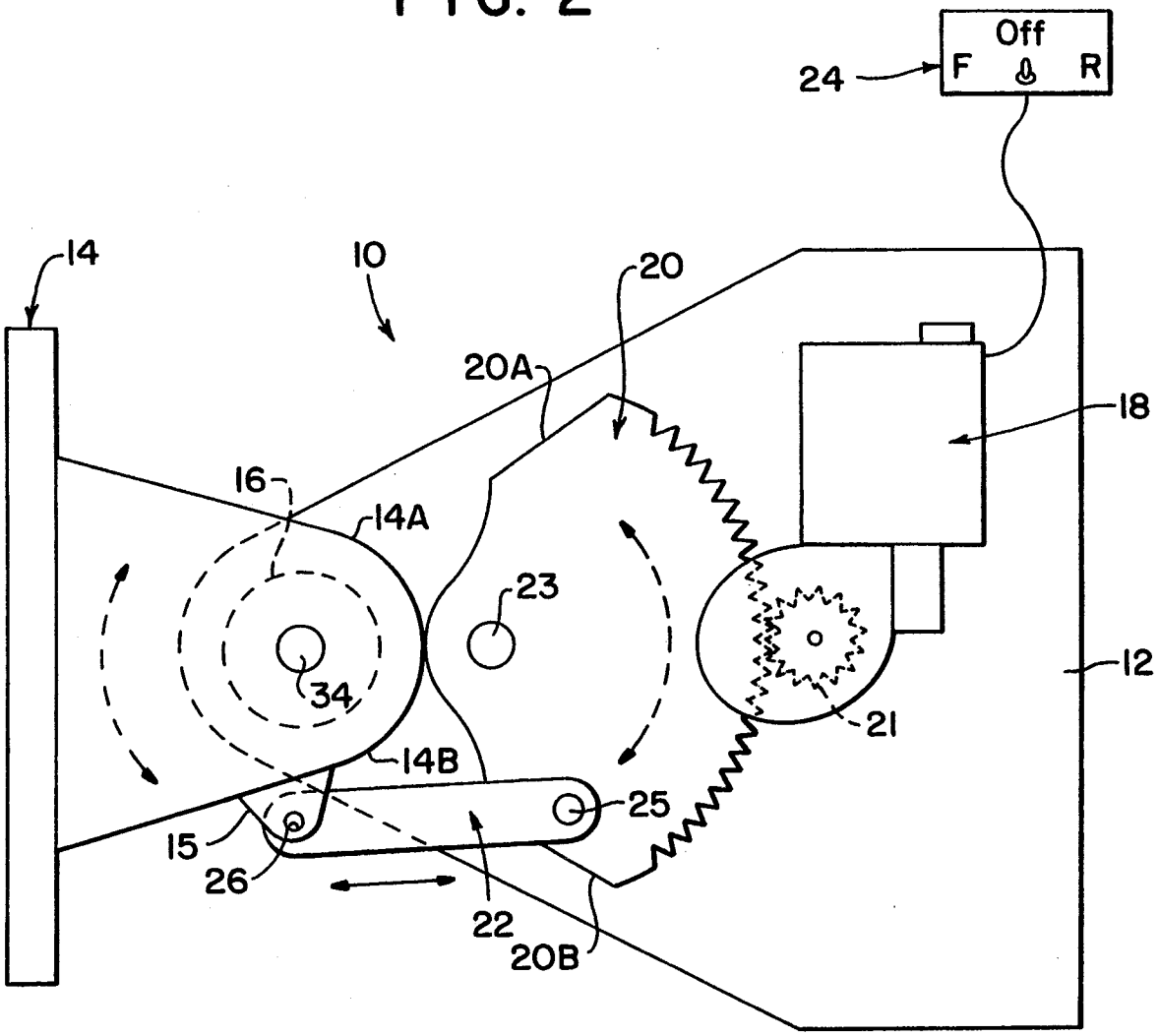
FIG. 2 is a top plan view of the embodiment of apparatus shown in FIG. 1.

In FIGS. 1 and 2 there is shown one embodiment 10 of mounting apparatus of the invention for mounting an auxiliary motor (e.g., a trolling motor) on a marine craft. Typically, the mounting apparatus is fastened to the transom of the craft.

The apparatus comprises (a) a frame member 12 which can be attached to the transom of a marine craft, e.g., by means of bolts, brackets or other suitable fasteners, (b) a motor mount member 14 to which the auxiliary motor may be detachably connected, (c) pivot means 16 for enabling the motor mount member to pivot relative to the frame member, (d) motor means 18 supported by the frame member; (e) gear means 20 carried by the frame member which is adapted to be rotatably driven by the motor means; and (f) a linking arm 22 connected between the gear 20 and the motor mount 14 for pivoting the motor mount 14 relative to the frame member 12 in response to rotation of gear 20.

A remote control switch 24 enables the control motor 18 to be operated in either forward or reverse direction for rotating gear 21 in one direction or the other. This causes gear 20 to rotate to the right or to the left when it is desired to cause the motor mount 14 to pivot to the left or the right, by means of linking arm 22. Gear 20 is rotatably mounted on frame 12 by means of bolt or pin 23. Arm 22 is pivotably mounted at one end to gear 20 by means of bolt or pin 25 and is pivotably mounted at its opposite end to an ear 15 on motor mount 14 by means of bolt or pin 26.

Preferably gear 20 is limited in the extent to which it can be rotated to about 55° from center position to either the right or to the left (for a total of about 110° rotation). This prevents the motor mount from becoming stuck in either the far right or far left position. Appropriate limits on such rotation of gear 20 are provided by edges 20A and 20B coming into contact with the edges 14A and 14B, respectively, of the portion of the motor mount 14 adjacent to the pivot means 16. Other equivalent means for limiting the extent of rotation of gear 20 may also be used, if desired.

The gear-driven means for effecting pivotal motion of the motor mount is far superior to conventional cable systems. The gear-driven system of this invention avoids the problem of cables slipping or breaking and instead results in a more positive and easily controlled pivotal movement of the motor mount.

Figure 3:
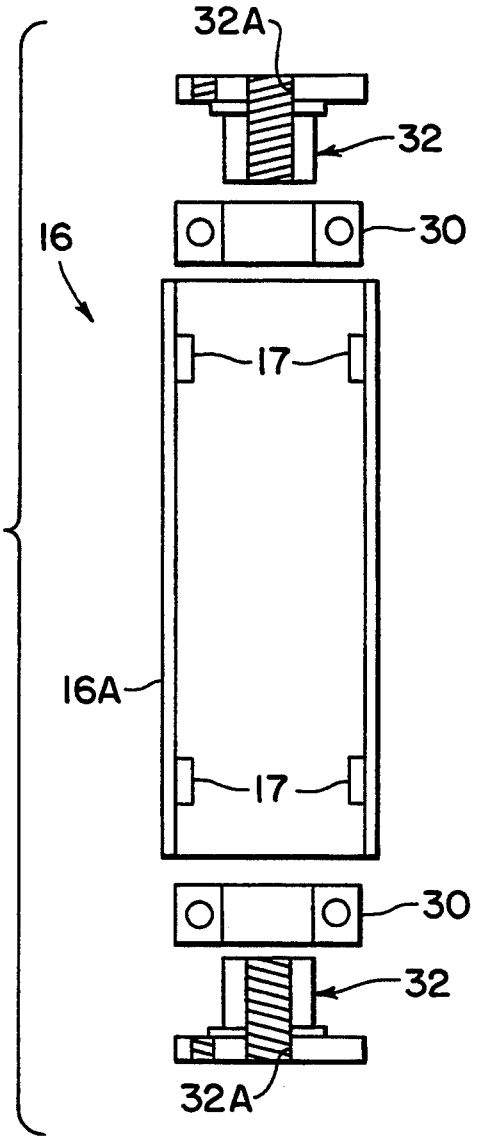
FIG. 3 is an explosion view showing a preferred embodiment of pivot means useful in the apparatus of the invention.

The preferred pivot means 16 is illustrated in FIG. 3 and it comprises an elongated tubular member 16A. A bearing member 30 is slidably inserted into the upper and lower ends of the tubular member. Stops or ledges 17 secured inside of member 16A limit the extent to which the bearings may be inserted. A bushing 32 with a threaded interior recess 32A is next fitted into each bearing.

The tubular member 16 is retained in an upright manner between upper and lower arms 13A and 13B which are integral with the motor mount member 14. Bolts 34 pass through appropriate openings in arms 13A and 13B and are threadably received in the recesses 32A. Frame member 12 is firmly secured to tubular member 16A. Thus, the motor mount 14 is able to pivot easily and precisely relative to frame 12. The presence, and the arrangement, of the two bearings 30 as shown herein is extremely advantageous because this enables the motor mount to pivot in a precise path, even with a heavy motor attached to motor mount 14. Without the presence of these axially-spaced bearings, the motor mount would not be able to pivot smoothly over a long period of time. Also, when heavier motors are mounted on the motor mount, additional forces are imposed on the pivot means which could cause binding if the bearings were not present.

Figure 4:
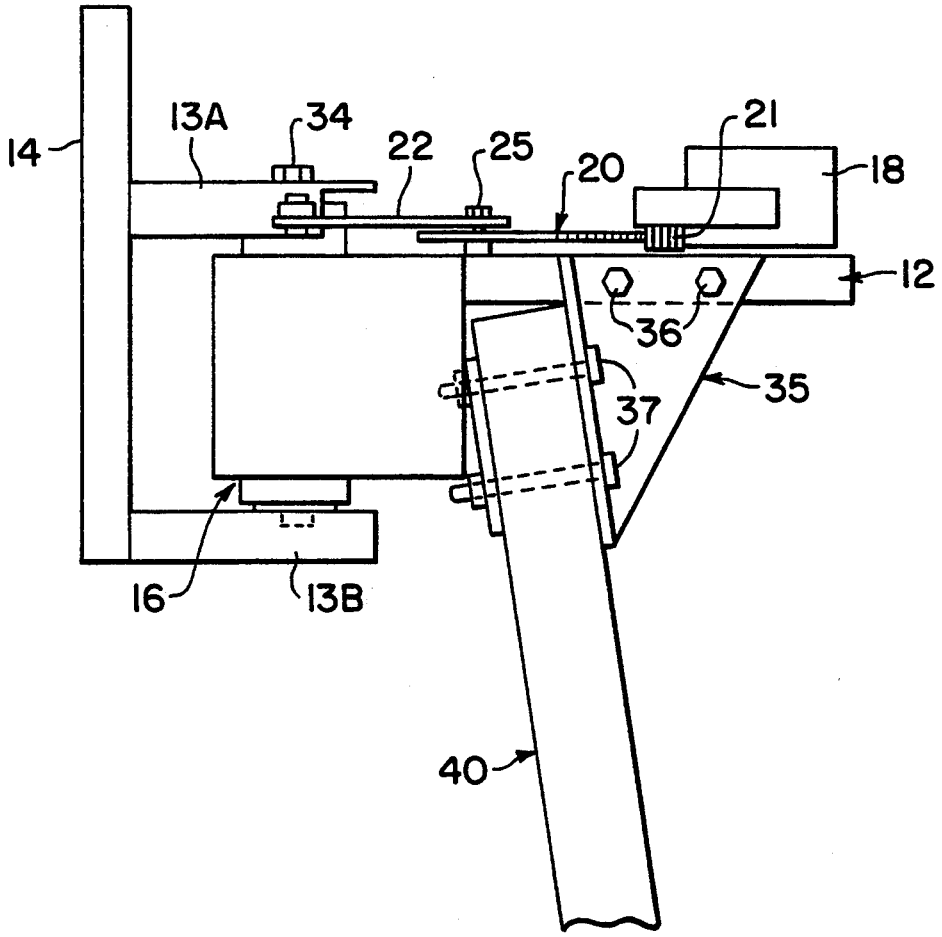
FIG. 4 is a side elevational view of one embodiment of apparatus of the invention mounted to the transom of a boat.

In FIG. 4 there is shown a side elevational view of the apparatus of the invention mounted to an angled transom 40 of a marine craft. For this purpose a mounting bracket 35 is used which is bolted to appropriately provided apertures in frame 12 by means of bolts 36. Bolts 37 pass through registering openings which are provided in transom 40 and the bracket 35. The bracket is angled in a manner such that the pivot means 16 and the motor mount 14 are in vertical planes, as shown.

Figure 5:
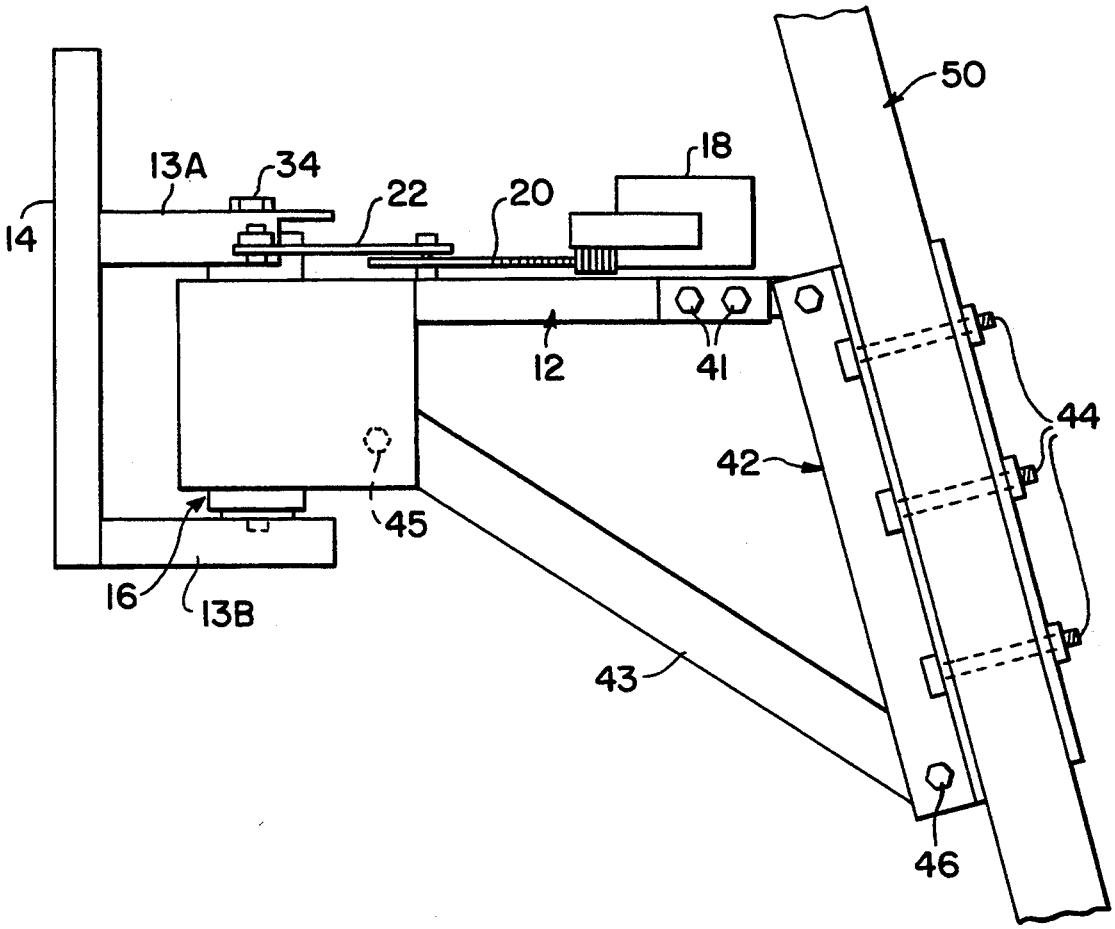
FIG. 5 is a side elevational view of another embodiment of apparatus of the invention mounted to the transom of a boat.

In FIG. 5 there is shown a side elevational view of the apparatus of the invention mounted to another type of angled transom 50. The mounting bracket 42 is secured to frame 12 at its upper end by means of bolts 41. Brace 43 is bolted (by bolt 45) to the portion of the frame surrounding the pivot means and is also bolted (by bolt 46) to the lower end of the bracket 42. Bolts 44 pass through registering openings in the transom and the bracket to secure the bracket to the transom. The pivot means and the motor mount member remain vertical, as shown.

Figure 6:
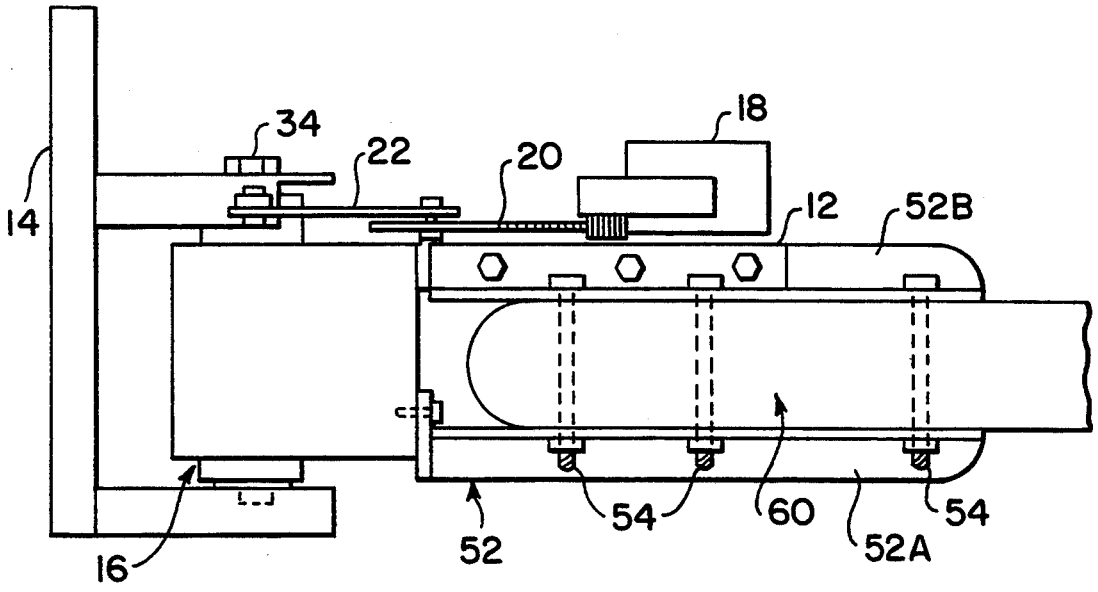
FIG. 6 is a side elevational view of another embodiment of apparatus of the invention mounted to a horizontal deck on the transom of a boat.

FIG. 6 is a side elevational view showing the apparatus of the invention mounted to a horizontal swim deck 60, which is an integral part of the transom of another style of marine craft. Mounting bracket 52 is bolted to the frame 12 and includes spaced-apart upper and lower sections 52A and 52B. Bolts 54 extend through registering openings in the bracket sections and the deck 60 to secure the apparatus to the deck. This is a very secure mount which enables the pivot means and the motor mount member to be maintained in vertical planes.

Other variants are possible without departing from the scope of this invention. The frame and the mounting brackets are composed of metal of the thickness and strength required in order to be able to safely support a motor of the desired size. Heavier brackets will generally be required when the apparatus is required to support larger auxiliary motors, for example.

What is claimed is:

1. Apparatus for attaching an auxiliary motor to the transom of a marine craft, said apparatus comprising:

(a) a frame member for attachment to the transom of said marine craft;

(b) a motor mount member for supporting said auxiliary motor; wherein said motor mount member comprises a plate member which is oriented in a generally-vertical plane;

(c) pivot means for enabling said motor mount member to pivot relative to said frame member;

(d) motor means supported by said frame member;

(e) gear means carried by said frame member and being adapted to be rotatably driven by said motor means; wherein said gear means includes opposite side edges which limit rotational movement of said motor mount member to an arc of about 110°; and (f) a linking member connected between said gear means and said motor mount member for pivoting said motor mount member relative to said frame member in response to rotation of said gear means;

wherein said pivot means is positioned between said motor mount member and said gear means.

2. Apparatus in accordance with claim 1, wherein said pivot means comprises upper and lower bearings which are axially aligned.

3. Apparatus in accordance with claim 2, wherein said bearings are aligned on an axis which is parallel to said plate member.

4. Apparatus in accordance with claim 2, wherein said motor means comprises a D.C. electric motor.

5. In combination with a marine craft having a transom, apparatus for attaching an auxiliary motor to said transom, wherein the apparatus comprises:

(a) a frame member for attachment to the transom of said marine craft;

(b) a motor mount member for supporting said auxiliary motor; wherein said motor mount member comprises a plate member which is oriented in a generally-vertical plane;

(c) pivot means for enabling said motor mount member to pivot relative to said frame member;

(d) motor means supported by said frame member;

(e) gear means carried by said frame member and being adapted to be rotatably driven by said motor means; wherein said gear means includes opposite side edges which limit rotational movement of said motor mount member to an arc of about 110°; and (f) a linking member connected between said gear means and said motor mount member for pivoting said motor mount member relative to said frame member in response to rotation of said gear means; wherein said pivot means is positioned between said motor mount member and said gear means.

6. A combination in accordance with claim 5, wherein said pivot means comprises upper and lower bearings which are axially aligned.

7. A combination in accordance with claim 6, wherein said bearings are aligned on an axis which is parallel to said plate member.

8. A combination in accordance with claim 6, wherein said motor means comprises a D.C. electric motor.

9. A combination in accordance with claim 8, wherein said frame member is attached to said transom by means of bolts.

* * * * *